United States Patent [19]

Siering

[11] Patent Number: 5,048,771

[45] Date of Patent: Sep. 17, 1991

[54] METHOD AND APPARATUS FOR A REPROGRAMMABLE PROGRAM MISSILE MEMORY

[75] Inventor: Erik R. Siering, Woodland Hills, Calif.

[73] Assignee: Hughes Aircraft Company, Los Angeles, Calif.

[21] Appl. No.: 437,044

[22] Filed: Nov. 15, 1989

[51] Int. Cl.[5] ..... G06F 1/00

[52] U.S. Cl. ..... 244/3.15; 364/900

[58] Field of Search ..... 364/900; 244/3.15, 3.11

[56] References Cited

U.S. PATENT DOCUMENTS

| | | | |
|---|---|---|---|
| 4,037,202 | 7/1977 | Terzian | 364/200 |
| 4,660,170 | 4/1987 | Hui et al. | 364/900 |
| 4,935,881 | 6/1990 | Lowenson et al. | 364/550 |

*Primary Examiner*—Mark Hellner

*Attorney, Agent, or Firm*—C. D. Brown; R. M. Heald; W. K. Denson-Low

[57] ABSTRACT

A method and apparatus are disclosed for a reprogrammable program missile memory module 26 which is placed within a missile 14 in substantially the same manner as the currently used programmable read only memory. The reprogrammable program memory module 26 provides for remote writing of tactical program data thereto while allowing the missile 14 to remain in a substantially operational state.

11 Claims, 3 Drawing Sheets

METHOD AND APPARATUS FOR A REPROGRAMMABLE PROGRAM MISSILE MEMORY

This invention was made with Government support under Contract No. N00019-85-G-0171 awarded by the Department of the Navy. The Government has certain rights in this invention.

BACKGROUND OF THE INVENTION

1. Field of the Invention

This invention relates to missiles, and more particularly to missiles having a reprogrammable program memory therein which may be used to receive and store a tactical software program from a remotely placed computer.

2. Discussion

Missiles are used in a wide variety of applications such as in the defensive armament of countries. In this regard, missiles are usually fitted with an explosive payload and are used to deliver this payload to a preselected location. Modern missiles are usually controlled in their launching and flight by a tactical computer processor contained therein. This processor normally controls the launching and flight of the missile by reading and interpreting a stored computerized program and then producing the necessary electronic signals in order to effect the interpreted missile actions represented by the computer program.

This tactical computer software program has usually been stored in conventional programmable read only memory (PROM) units which were then subsequently manually placed within the missile. This placement required the disassembly of a great part of the missile and resulted in the missile being "deactivated" or "out of commission" for a relatively long period of time, which resulted in a weakening of overall defensive strength. A subsequent change in the computer program, stored within the aforementioned PROMS, required substantially the same type of missile disassembly, therefore reducing the flexibility of the overall missile defensive structure and resulting in an concomitant waste of resources.

SUMMARY OF THE INVENTION

According to the teachings of the preferred embodiment of this invention, a reprogrammable memory may be placed within a missile in substantially the same manner and having substantially the same electrical characteristics as the current memory chassis containing a plurality of programmable read only memory (PROM) entities thereon.

The reprogrammable memory may remotely receive and store a tactical software program, generated and transmitted from a host computer, and is generally electronically coupled to the missile's tactical processor. This coupling enables the contained software program to be interpreted by the tactical processor of the missile and allows the processor to generally control the launching and the flight of the missile in accordance with the tactical software program.

The stored tactical software program may be modified by causing the host computer to generate a new tactical software program which, when loaded, causes the effective deletion of the currently stored tactical software program within the reprogrammable program memory.

These and other aspects, features, and advantages of this invention will be more readily understood by reviewing carefully the following detailed description taken in conjunction with the accompanying drawings and claims.

BRIEF DESCRIPTION OF THE DRAWINGS

For a more complete understanding of the present invention relative to the advantages thereof, reference may be made to the following detailed description taken in conjunction with the accompanying drawings in which.

DESCRIPTION OF THE PREFERRED EMBODIMENT

Figure 1:
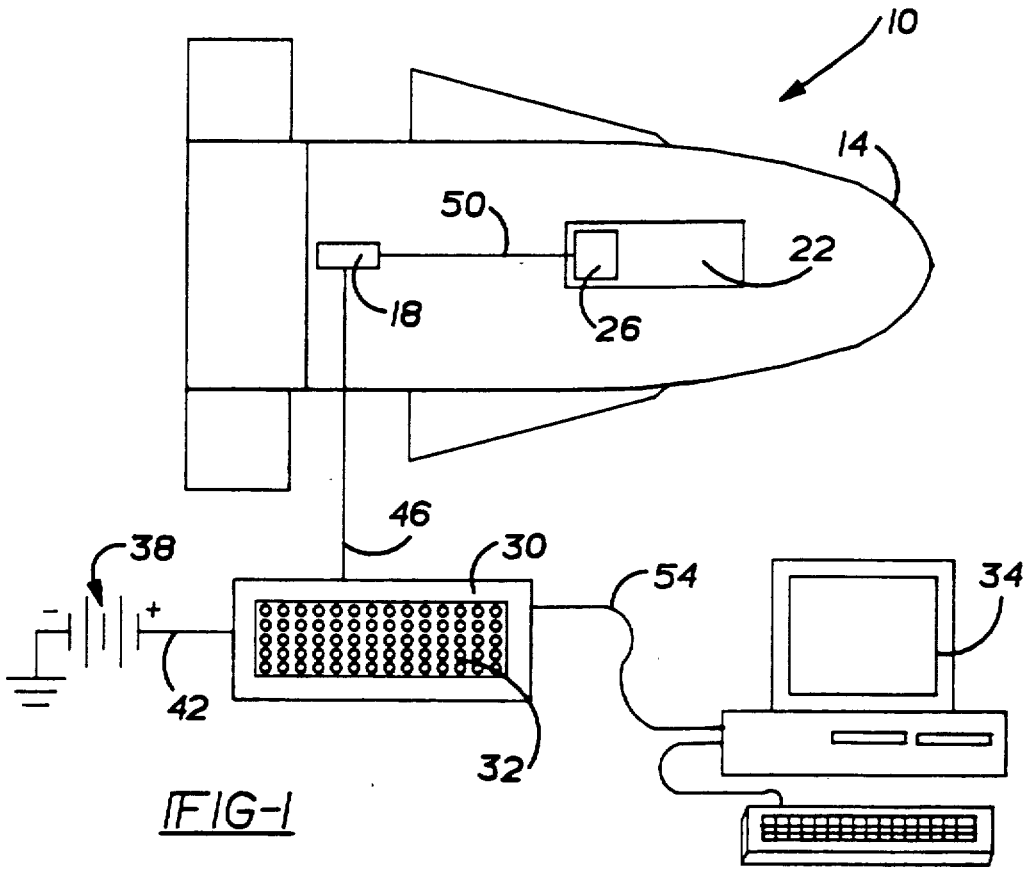
FIG. 1 is an illustration of the reprogrammable program memory of the preferred embodiment of this invention as used within a typical missile.

Referring to FIG. 1, there is shown a missile system 10 including a typical missile 14 (such as an AIM-54C Missile) having the usual missile umbilical harness 18 and the usual tactical processor electronics unit 22 therein. Missile system 10 includes a reprogrammable program memory module 26, made in accordance with the teachings of the preferred embodiment of this invention and fitted within unit 22 in substantially the same manner and having substantially the same electrical interface thereto as existing programmable read only memory (PROM) units currently deployed within missile 14. System 10 also includes a patch panel 30 having a standard DSM-130(V) General Missile Test Set (GMTS) 32 therein and a computer 34, which in the preferred embodiment of this invention, is an IBM-compatible personal computer having dual floppy disk drives and a typical graphics card therein.

Panel 30 is normally electrically coupled to a source of electrical power 38 through electrical bus 42 and is further electronically coupled to umbilical harness 18 by signals on electrical bus 46 in a typical manner. Memory module 26 is electrically coupled to harness 18 by signals on electrical bus 50 while computer 34 is electrically coupled to test set 32 by signals on electrical bus 54.

Figure 2:
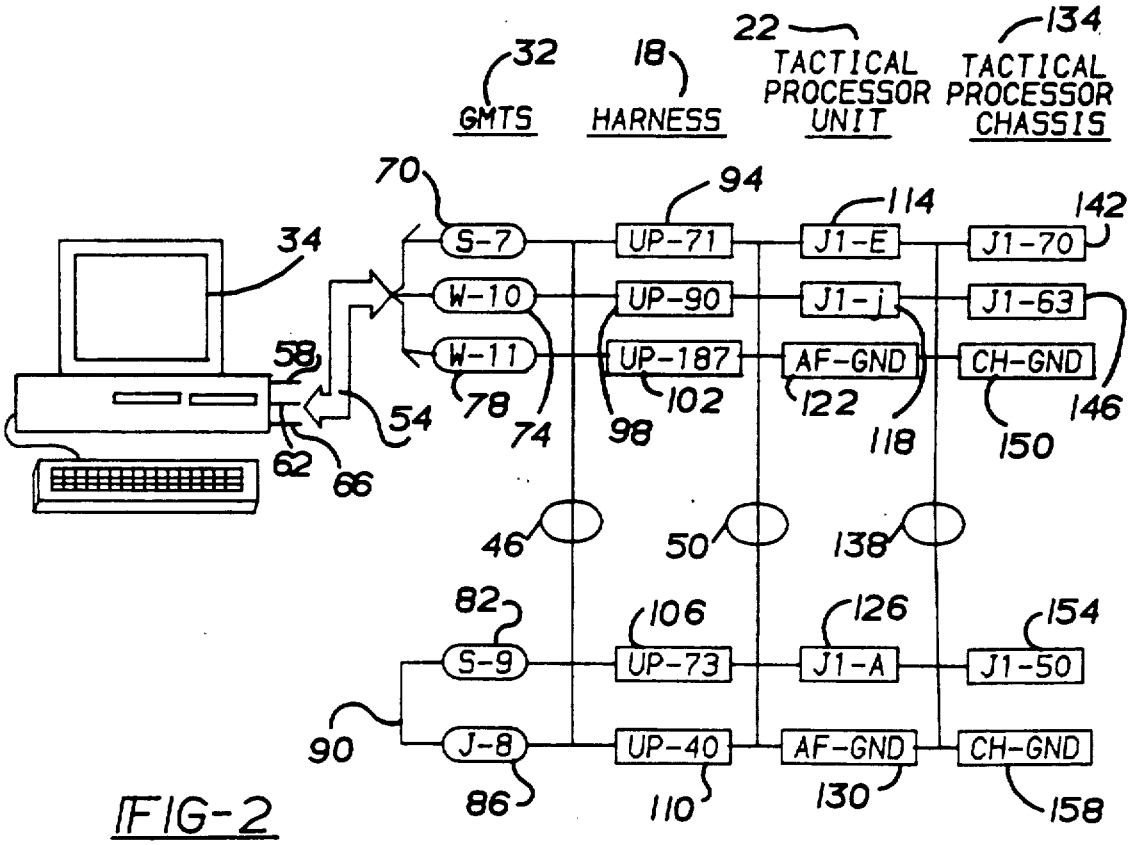
FIG. 2 is an illustration of the electronic coupling of the reprogrammable program memory generally shown in FIG. 1 to a host computer.

Referring now to FIG. 2, there is illustrated the associated electrical interconnection of computer 34, harness 18, and memory module 26 within the missile system 10. Specifically, as shown, electrical bus 54 interconnects typical RS-232-C type receive data, transmit data, and return signal lines 58-66 respectively of computer 34 to the usual electrical interconnection ports "S-7", "W-10", and "W-11" which are associated with the test set 32. Ports "S-7", "W-10" and "W-11" are respectively referred to as ports 70-78 in FIG. 2. Additionally, in the preferred embodiment of this invention, typical electrical interconnection ports 82 and 86 (i.e. typical "S-9" and "J-8" ports) associated with test set 32 are electrically jumpered together by signal line 90.

Further, as shown in FIG. 2, electrical bus 46 couples interconnection ports 70-86 to interconnection ports 94-110 respectively, which are associated with umbilical harness 18. Specifically, ports 94–110 are the typical "UP-71", "UP-90", "UP-187", "UP-73" and "UP-40" ports. These interconnection ports 94–110 are then electrically coupled, in the manner shown in FIG. 2, to typical missile tactical processor unit 22 by electrical bus 50. Specifically, electrical bus 50 interconnects ports 94–110 to typical interconnection ports 114–130 respectively associated with tactical processor unit 22. Ports 114–130, in FIG. 2, specifically reference typical "J1-E", "J1-J", "AF-GND", "J1-A" and "AF-GND" ports respectively.

Further, as shown in FIG. 2, ports 114–130 are respectively electrically coupled to the typical missile electrical memory chassis 134 associated with tactical processor electronics unit 22 in which memory 26 is placed, by use of the typical internal electrical bus 138 of tactical processor unit 22. Specifically, ports 114–130 are respectively electrically coupled to typical interconnection ports 142–158 of chassis 134 which references typical "J1-70", "J1-63", "CH-GND", "J1-50", and "CH-GND" ports respectively.

Figure 3:
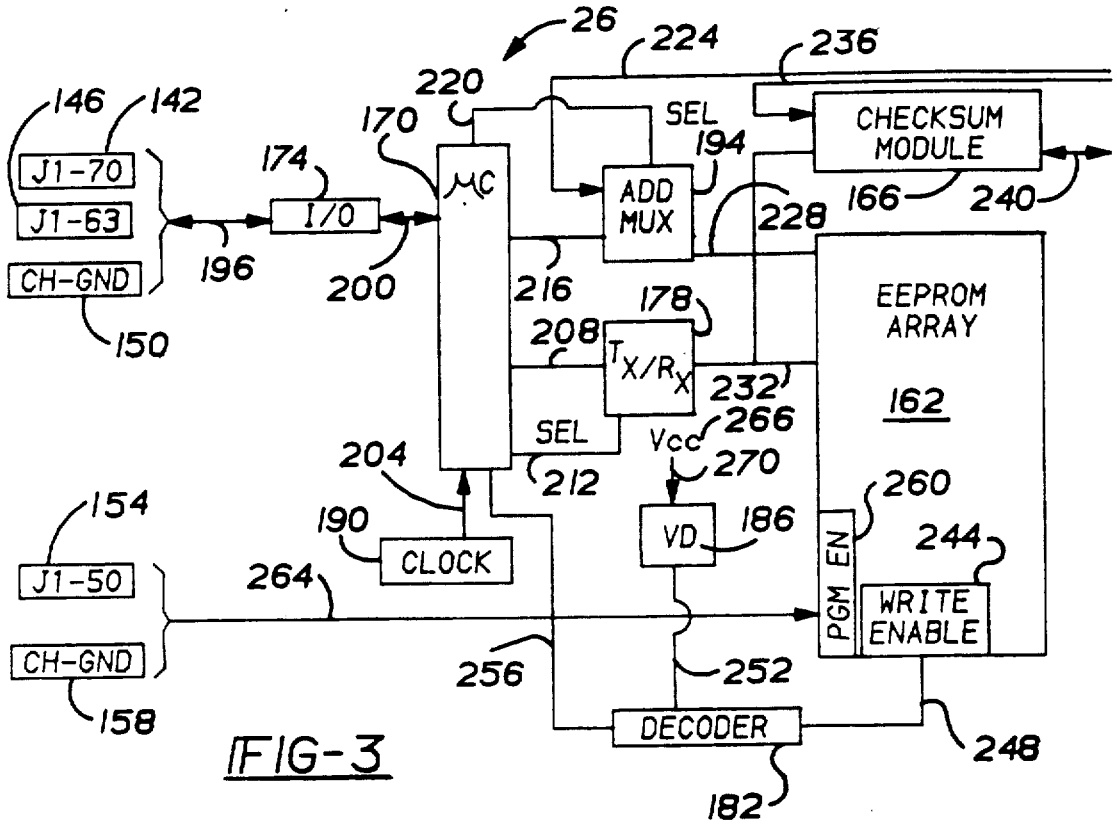
FIG. 3 is a block diagram of the reprogrammable program memory shown in FIG. 1.

Referring now to FIG. 3, there is shown a block diagram of the reprogrammable tactical program memory module 26 made in accordance with the teachings of the preferred embodiment of this invention. It contains electrically erasable programmable read only memory array 162, checksum module 166, microcontroller 170, input/output controller 174, transceiver 178, decoder 182, voltage detector 186, clock source 190, and address multiplexer 194.

Specifically, controller 174 is electrically coupled to interconnection ports 142–150 by signals on bus 196 and is further electronically coupled to microcontroller 170 by signals on bus 200. Microcontroller 170 is also electrically coupled to clock 190 by signal on bus 204 and is electronically coupled to transceiver 178 by signals on bus 208 and also by signal on bus 212. Additionally, microcontroller 170 is electronically coupled to address multiplexer 194 by signals on bus 216 and by signals on bus 220.

Multiplexer 194 is electronically coupled to the tactical processor of unit 22 by signals on bus 224 and to memory array !62 by signals on bus 228. Transceiver 178 is electronically coupled to array 162 and to checksum module 166 by signals on bus 232 while checksum module 166 is additionally electronically coupled to the tactical processor of unit 22 by signals on bus 236 and signals on bus 240.

Decoder 182 is electronically coupled to write enable port 244 of memory array 162 by signals on bus 248 while also being electronically coupled to voltage detector 186 by signals on bus 252 and to microcontroller 170 by signals on bus 256. Also electronically coupled to program enable port 260 of memory array 162 are interconnection ports 154 and 158 by means of signals on bus 264.

Voltage source 266, denoted in FIG. 3, as "Vcc" is electrically coupled to voltage detector 186 by signals on bus 270 and, in the preferred embodiment of this invention, originates from tactical processor unit 22 and has a normal voltage level of approximately +5 volts associated therewith. Voltage source 266 is used to electrically power entities 162–194 of the reprogrammable program memory module 26.

The following table lists the typical industrial specifications of entities 162–194 used in the preferred embodiment of this invention:

| ENTITY | SPECIFICATION |
|---|---|
| Memory array-162 | ATMEL-64Kx24 bit EEPROM Array |
| Checksum module-166 | Hughes - 3905660 |
| Microcontroller-170 | INTEL-M80C51 Computer |
| Input/output controller-174 | Maxim-MAX235 Driver/ Receiver |
| Input/Output transceiver-178 | Texas Instrument - 54LS245 |
| Decoder-182 | Fairchild - 54ACT138 |
| Voltage detector-186 | ICL-8211 |
| Clock-190 | 11.059 MHz Crystal Oscillator Created in Accordance with MIL-SPEC M53310/16 |
| Multiplexer-194 | Fairchild - 54F541 |

Figure 4B:
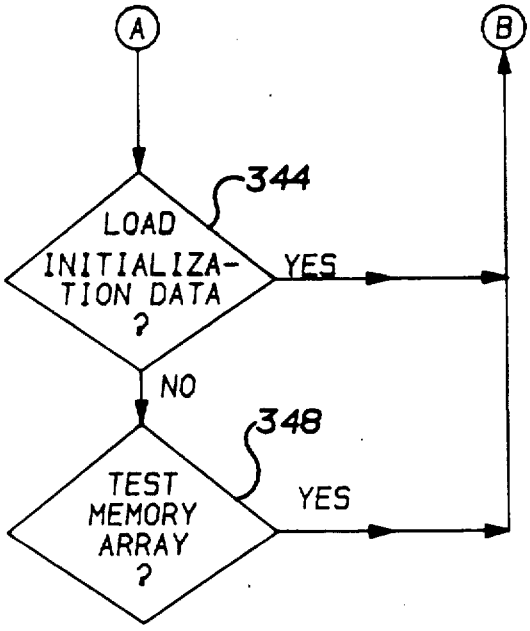
FIGS. 4(A-B) are flowcharts generally describing the operation of the microcontroller of the reprogrammable program memory shown generally in FIG. 1.
Figure 4A:
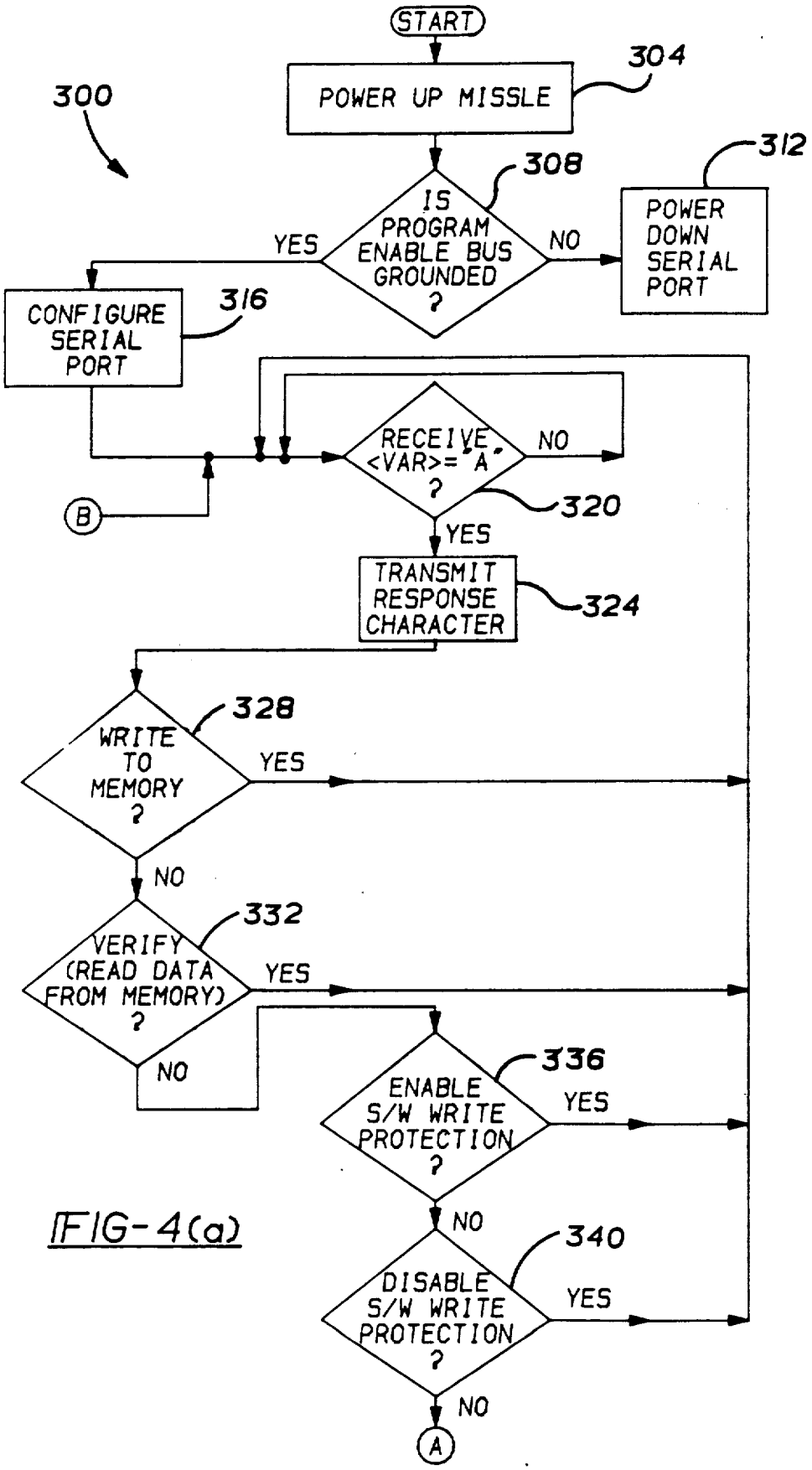

The operation of reprogrammable program memory module unit 26 is generally controlled by firmware contained within microcontroller 170 according to the flowchart 300 illustrated in FIGS. 4(A–B). It should initially be realized, by one of ordinary skill in the art, that bus 264, electronically coupled to port 260 of array 162, must always be electrically grounded if data is to be written into array 162. That is, interconnecting signal line 90 must be electronically coupled to electrical ground before data, from computer 34, may be downloaded into array 162.

Assuming that bus 264 is at an electrically grounded state, step 304 of flowchart 300 indicates an initial step of electrically powering up missile 14. Next, step 308 requires microcontroller 170 to determine if bus 264 is electrically grounded as earlier discussed. If not, then step 312 is entered which requires that microcontroller 170 power down its serial port since no data may be written into array 162. If bus 264 is electrically grounded, step 316 is entered into and requires microcontroller 170 to configure port 174, in the usual manner, to receive data at one of a plurality of speeds, such as 9,600 baud or 19,200 baud.

After step 316 has been completed, step 320 requires that microcontroller 170 continuously wait for a variable represented, in the preferred embodiment of this invention, as "A" to be transmitted thereto from computer 34. Upon receiving the variable "A", microcontroller 170, in step 324, transmits a predefined response character, in a typical handshaking arrangement, back to computer 34. After step 324 has been completed, one of the steps 328–348, may be ordered, by computer 34, to be completed and upon its completion microcontroller 170 is directed, by firmware therein, back to step 320.

In step 328, computer 34 may write or download data to memory array 162. This is accomplished by the data and address associated therewith being transmitted by computer 34 to input/output unit 174 through bus 196. This information is then passed to microcontroller 170 through bus 200. The address sent by computer 34, is then passed from the received data on bus 200 and sent to address multiplexer 194 by bus 216. Select bus 220 is also controller by microcontroller 170 and is used, in this scenario, to direct multiplexer 194 to output the contents of bus 216 onto bus 228 and then to array 162, in a typical manner.

The actual data, sent by computer 34, by means of bus 200, is placed onto bus 208 and is directed to array 162 by input/output transceiver 178 in the usual manner by means of bus 232. Upon receipt of the contents of busses 228 and 232, array 162 then places the data within bus 232 in the memory location specified by the aforementioned contents of bus 228. This data may typically overwrite existing data in the specified memory location thereby causing deletion of the same. Thusly, a new tactical software program may be downloaded to array 162 causing the existing tactical software program to be substantially deleted therefrom.

It should be noted that this aforementioned write operation may only be achieved if signal on bus 248 allows write enable port 244 of array 162 to accept data. That is, voltage "Vcc" associated with power supply 266 must be at a level of at least +4.5 volts and this voltage level is detected by voltage detector 186 in the usual manner. Upon detecting a voltage level of power supply 266, detector 186 sends a signal on bus 252 to decoder 182 and if the signal on bus 252 indicates that the level of power is at least +4.5 volts, decoder 182 sends a signal on bus 248 to port 244 allowing array 162 to have data written therein. If the voltage level associated with voltage supply 266 is below approximately +4.5 volts, then signal on bus 248 precludes array 162 from receiving data in the manner previously specified. This detection of voltage levels associated with power supply 266 substantially prevents spurious data writes into array 162 especially at the powering up or down of system 10. In this regard, the aforementioned voltage detection methodology supplants typically available write protection apparatus associated with array 162. Microcomputer 170 controls the operation of decoder 182 in the usual manner by signals on bus 256.

As illustrated in step 332, data can be read from array 162, either by computer 34 or by the tactical missile processor within unit 22. An address of the location within array 162 to be read from is placed upon either bus 216 (in the manner previously specified for the address of data to be written by computer 34) or upon bus 224 by the tactical missile processor (i.e. to fetch the next operable instruction). Microcontroller 170, using signal on bus 220, orders multiplexer 194 to place either address signals on bus 216 or address signals on bus 224 to array 162 by means of bus 228, in a typical manner.

Upon receiving signal on bus 228, array 162 either places the contents of the addressed data location onto bus 232 (i.e. if the address were specified by computer 34) or directly to the tactical missile processor in the usual manner. Signals on bus 232 are received by transceiver/receiver 178 and directed to microcontroller 170 by signals on bus 208. Microcontroller 170 then places these signals onto bus 200 and input/output transceiver 174 receives them and directs them to computer 34 by signals on bus 196.

Computer 34, in steps 336 and 340, writes preselected data having a preselected address associated therewith, in the manner previously specified, to array 162 which will typically cause the usual write protection, associated with array 162, to be enabled or disabled respectively.

Computer 34, in step 344, orders microcontroller 170 (by transmission of a preselected control character) to write, in the manner previously specified, a preselected amount of data (defining typical array 162 initialization data) to array 162. This data is contained within the firmware associated with microcontroller 170 and is used in order to ensure proper missile system 10 powerup in the event of uncertain memory contents associated with array 162.

Step 348 also utilizes data, placed in the firmware of microcontroller 170. Specifically, upon selection of step 348, computer 34 orders microcontroller 170 (by transmission of a unique control character) to write a predefined data pattern, stored in firmware, into a predefined memory address of array 162 in the manner previously specified. Next, microcontroller 170 reads this data in the manner previously specified, from array 162 and reports back to computer 34 by signals on bus 196 as to whether or not the aforementioned writing of the predefined data to array 162 was successful. Therefore, the operations of step 348 allow a user of computer 34 to determine if reprogrammable program memory unit 26 is in operation and allows the expediting of system tests associated with unit 26.

A checksum module 166 generates typical parity checksum data associated with the contents of array 162 by receiving this contained data on bus 232 and then being directed, by signals on bus 236 by the tactical processor, to issue a checksum signal on bus 240 thereto. This checksum is then used by the tactical processor to determine the validity of data contained within array 162. Clock 190 serves to synchronize the operations associated with flowchart 350 by microcontroller 170 by generating clock signals on bus 204 thereto.

In accordance with the present invention, steps 304–348 may be accomplished by the cooperative communication of computer 34, microcontroller 170, and array 162 without requiring costly disassembly of missile 14 and may further be accomplished while missile 14 is in a powered or substantially operational state. It should also be realized by one of ordinary skill in the art that the data stored within the previously specified array may reside there for at least ten years without substantial degradation associated therewith.

It is to be understood that the invention is not to be limited to the exact construction or method illustrated and described above, but that various changes and modifications may be made without department from the spirit and scope of the invention as described in the subjoined claims that follow.

What is claimed:

1. A missile system including a missile to be launched and thereafter to be in flight, said launching and said flight of said missile being defined by a tactical software program, said missile system comprising:

(a) computer means, remotely located from said missile, for creating and generating instructions for said tactical software program;

(b) program memory means, contained within said missile and electronically coupled to said computer means, for receiving said generated tactical program and for storing the same therein, said program memory means comprising:

(i) an electrically erasable programmable read only memory array, electronically coupled to said computer means;

(ii) microprocessor means, electronically coupled to said electrically erasable programmable read only memory array, for controlling said reception of said generated tactical software program by said electrically erasable programmable read only memory array; and (iii) checksum means, electronically coupled to said tactical processor means, for generating a plurality of parity checksums associated with said program memory means; and (c) tactical processor means, contained within said missile and electronically coupled to said program memory means, for interpreting said stored tactical software program contained within said program memory means and for controlling said launching of said missile and said flight of said missile in response to said interpretation of said stored tactical software program.

2. The missile system of claim 1, wherein said program memory means further comprises:

voltage detector means, electronically coupled to said program memory means for selectively permitting said generated tactical software program to be written into said memory means.

3. The missile system of claim 1 further comprising:

a general missile test set, electronically coupled to said program memory means and to said computer means.

4. Apparatus for remotely placing one of a plurality of different tactical software programs within a missile to be launched and thereafter to be in flight, said launching and said flight of said missile being controlled by said tactical software program, said apparatus comprising the combination of:

(a) computer means, remotely located from said missile, for creating and generating said plurality of different tactical software programs;

(b) program memory means, contained within said missile and electronically coupled to said computer means, for receiving and storing a first tactical software program of said plurality of different tactical software programs from said computer and for subsequently receiving a second, and different, tactical software program from said computer means and for storing said second tactical software program while simultaneously deleting said previously received and stored first tactical software program; said program memory means comprising:

(i) an electrically erasable programmable read only memory array electronically coupled to said computer means;

(ii) microprocessor means, electronically coupled to said electrically erasable programmable read only memory array, for controlling said reception of said first and said second tactical software programs by said electrically erasable programmable read only memory array; and (iii) checksum means, electronically coupled to said tactical processor means, for generating a plurality of parity checksums associated with said program memory means; and (c) tactical processor means, contained within said missile and electronically coupled to said program memory means for interpreting said first and said second stored tactical software program contained therein and for controlling said launching of said missile and said flight of said missile in response thereto.

5. The apparatus of claim 4, wherein said program memory means further comprises:

voltage detector means, electronically coupled to said electrically erasable programmable read only memory means for selectively coupling said first and second tactical software programs thereto.

6. The apparatus of claim 4 further comprising:

a general missile test set, electronically coupled to said program memory means and to said computer means.

7. A method for remotely placing and storing one of a plurality of tactical software programs within a missile, said missile having a tactical processor therein, said missile normally to be launched and to be in flight thereafter, said launching and said flight of said missile to be normally controlled by said tactical processor upon reading and interpreting said tactical software program, said method comprising:

(a) providing computer means remotely located from said missile, for creating and generating said plurality of tactical software programs therefrom;

(b) providing electrically erasable programmable read only memory means, within said missile, for receiving and storing a first program of said plurality of tactical software programs and for subsequently receiving and storing a second and different program of said plurality of tactical software programs and for simultaneously deleting said first program upon said receipt of said second program;

(c) electronically coupling said electrically erasable programmable read only memory means to said tactical processor and to said computer means whereby said created and generated plurality of tactical software programs may be received and stored by said electrically erasable programmable read only memory means;

(d) providing microprocessor means, electronically coupled to said electrically erasable programmable read only memory means, for controlling said reception of said created and generated plurality of tactical software program by said electrically erasable programmable read only memory array; and (e) providing checksum means, electronically coupled to said tactical processor, for generating a plurality of parity checksums associated with said electrically erasable programmable read only memory means.

8. The method of claim 7 further comprising:

(f) providing a patch panel containing a general missile test set, remote from said missile; and (g) electronically coupling said patch panel to said computer means and to said electrically erasable programmable read only memory means.

9. The method of claim 7 further comprising:

(f) providing voltage detector means, electronically coupled to said electrically erasable programmable read only memory means for selectively coupling said created and generated plurality of tactical software programs thereto as a function of a voltage level associated with said tactical processor.

10. A method for remotely placing and storing a tactical software program within a missile, said missile having a tactical processor therein, said missile normally to be launched and to be in flight thereafter, said launching and said flight of said missile to be normally controlled by said tactical processor upon reading and interpreting said tactical software program, said method comprising:

(a) placing an electrically erasable programmable read only memory array within said missile;

(b) electronically coupling said electrically erasable programmable read only memory array to said tactical processor;

(c) providing a patch panel having a general missile test set, remote from said missile;

(d) electronically coupling said general missile test set to said electrically erasable programmable read only memory array;

(e) providing computer means, remotely located from said missile, for creating and transmitting said tactical software program therefrom; and (f) electronically coupling said computer means to said general missile test set;

(g) providing checksum means, electronically coupled to said tactical processor means, for generating a plurality of parity checksums associated with said electrically erasable programmable read only memory array; and (h) providing microprocessor means, electronically coupled to said electrically erasable programmable read only memory array, for controlling said reception of said tactical software program by said electrically erasable programmable read only memory array, whereby said created and transmitted tactical software program may be received and stored by said electrically erasable programmable read only memory.

11. The method of claim 10 further comprising:

(i) providing voltage detector means, electronically coupled to said electrically erasable programmable read only memory array for selectively coupling said created and transmitted tactical software program thereto as a function of a voltage level associated with said tactical processor.

* * * * *